US006413633B1

(12) United States Patent
McCullough

(10) Patent No.: US 6,413,633 B1
(45) Date of Patent: Jul. 2, 2002

(54) ACTIVATED BIREGIONAL FIBER(S)

(75) Inventor: Francis Patrick McCullough, 3701 Carbtex Rd., Angleton, TX (US) 77515

(73) Assignee: Francis Patrick McCullough, Angleton, TX (US)

( * ) Notice: Subject to any disclaimer, the term of this patent is extended or adjusted under 35 U.S.C. 154(b) by 0 days.

(21) Appl. No.: 09/837,772

(22) Filed: Apr. 18, 2001

(51) Int. Cl.[7] ..... D01F 6/00
(52) U.S. Cl. ..... 428/367; 428/373
(58) Field of Search ..... 428/373, 394, 428/367; 423/447.1

(56) References Cited

U.S. PATENT DOCUMENTS

| | | | | | |
|---|---|---|---|---|---|
| 5,700,573 | A | | 12/1997 | McCullough | |
| 5,763,103 | A | | 6/1998 | McCullough | |
| 5,776,607 | A | * | 7/1998 | McCullough | 428/367 |
| 5,776,609 | A | * | 7/1998 | McCullough | 428/367 |
| 5,837,626 | A | * | 11/1998 | McCullough | 428/370 |
| 5,858,530 | A | | 1/1999 | McCullough | |
| 6,156,287 | A | | 12/2000 | Ko | |

* cited by examiner

*Primary Examiner*—Newton Edwards
(74) *Attorney, Agent, or Firm*—Nis H. Juhl

(57) ABSTRACT

The invention resides in a novel ignition resistant activated biregional fiber that is extremely flexible due to the presence of an inner core of a thermoplastic polymeric composition in the fiber that is surrounded by an outer sheath of activated carbon. The invention also discloses a process for the manufacture of flexible activated biregional fiber(s) by heating oxidation stabilized biregional fibers or carbonaceous biregional fibers in an activating atmosphere for a period of time and at a temperature sufficient to form an activated carbonaceous outer region in the fiber while the inner core of the fiber remain as a thermoplastic polymeric composition. The activated biregional fibers are particularly characterized by having a highly porous internal structure with an internal surface area of from about 50 $m^2/g$ to greater than 2000 $m^2/g$ depending on fiber diameter. Preferred end uses for the biregional activated carbon fiber(s) include, for example, air and water purification, solvent recovery, waste water treatment, the removal of noxious gases such as sulfur dioxide from stack gases, gas separation and storage, etc.

9 Claims, No Drawings

ACTIVATED BIREGIONAL FIBER(S)

FIELD OF THE INVENTION

The present invention resides in an ignition resistant activated biregional fiber(s) having an inner region of a thermoplastic polymeric core and an activated outer sheath.

The present invention also resides in a method of making an activated biregional fiber(s) comprising an inner region of a thermoplastic polymeric core surrounded by an outer sheath region of an activated carbonaceous material. The activated biregional fiber is derived from an oxidation stabilized biregional fiber(s) which comprises an inner region of a thermoplastic polymeric core and an oxidation stabilized outer sheath region. In the method of the invention, the oxidation stabilized biregional fiber is subjected to an activating gas at a relatively high temperature and for a period of time sufficient to activate the outer sheath region.

The invention also relates to a method for the manufacture of an activated biregional fiber(s) derived from a biregional fiber(s) comprised of an inner region of a thermoplastic polymeric core and an outer region of a carbonaceous sheath. In the method of the invention, the biregional carbonaceous fiber is subjected to an activating gas at a relatively high temperature and for a period of time sufficient to activate the outer sheath region. The activated biregional fiber(s) has an inner region of a thermoplastic polymeric core and an outer sheath region of an activated carbonaceous material.

BACKGROUND OF THE INVENTION

Oxidation stabilized biregional fiber(s) and their method of manufacture are known from U.S. Pat. No. 5,763,103 issued Jun. 9, 1998 to Francis P. McCullough, the subject matter of which is incorporated herein in its entirety. This patent discloses an oxidation stabilized biregional fiber(s) which is produced from a homogenous polymeric composition in which an outer sheath portion of the fiber is oxidation stabilized while the inner core of the fiber remains in a thermoplastic polymeric condition. The patent is a divisional of application Ser. No. 428,691, now U.S. Pat. No. 5,700,573 issued Dec. 23, 1997.

U.S. Pat. No. 5,700 573 issued Dec. 23, 1997 to Francis P. McCullough discloses a biregional carbonaceous fiber(s) which is produced from a homogenous polymeric composition in which an outer fiber portion of the polymeric material is oxidation stabilized and then carbonized to form a fiber having a thermoplastic inner core and a thermoset or carbonized outer sheath. The subject matter of this patent is incorporated herein in its entirety.

DEFINITIONS

The term "biregional fiber" or "biregional fibers" used herein is generally applicable to fibers having an inner core of a thermoplastic polymeric composition and a surrounding outer sheath that can be oxidation stabilized or carbonized in accordance with the processes described in the patents to McCullough acknowledged and specifically referred to herein above. The broad definition for the oxidation stabilized biregional fiber and the biregional carbonaceous fiber is applicable as well to the biregional activated carbon fiber(s) of the invention in which the inner core also comprises a thermoplastic polymeric composition while the surrounding outer sheath, however, comprises an activated carbonaceous material.

The term "activated" used herein refers to a carbonaceous material having a greatly enhanced surface area. The material behaves similar to an "activated carbon" material, which is characterized by having a high absorptivity for many gases, vapors and colloidal solids. See Hawley's Condensed Chemical Dictionary, Eleventh Ed. More specifically, activated carbon that is known in the art is carbonized and activated throughout the particle or fiber whereas the activated biregional fiber(s) of the invention has high surface area and porosity in the sheath but is not activated or carbonized in the core. Accordingly, the activated fiber of the invention behaves similar to that of activated carbon, i.e. it is absorptive, but is much faster in kinetic rate since the fibers are much smaller than activated carbon granules and present more readily contactable distributed surface per unit weight. More importantly, the activated fiber(s) of the invention is very flexible and not brittle like activated carbon fibers of the art since the fiber of the invention is biregional having an inner core of the thermoplastic polymeric composition All percentages given herein are in "percent by weight" unless otherwise specified.

SUMMARY OF THE INVENTION

It is an object of the invention to provide A biregional fiber(s) in which the outer surface region of an oxidation stabilized or carbonized biregional fiber(s) is activated so as to provide a highly porous structure having an extremely large surface area of from about 50 $m^2$/gm (square meters per gram) to greater than about 2000 $m^2$/gm, depending on the diameter of the fiber.

It is an another object of the invention to provide a process of manufacture in which an oxidation stabilized biregional fiber(s) is activated on it outer region (sheath region) to form a fiber having an inner core region of a thermoplastic polymeric composition which is surrounded by an outer sheath region of activated carbonaceous material.

It is also within the ambit of the present invention to activate a biregional fiber(s) in which the outer region of the fiber has been partially or fully carbonized. Activation being accomplished under the same conditions as described in connection with the oxidation stabilized biregional fiber(s).

It is also within the scope of the invention to activate a biregional fiber comprising 2 or more co-extruded compatible polymeric compositions in which one thermoplastic polymeric composition is extruded as an inner core and another compatible polymeric composition is extruded so that it surrounds the core to form an outer sheath of the fiber. The biregional polymeric fiber is subsequently oxidation stabilized and activated or, optionally, carbonized and then activated.

It is also an object of the invention to form of a multiplicity of the activated biregional fibers into articles of manufacture in the form of a wool-like fluff, a generally planar non-woven sheet, web, felt or batting, a compression formed panel, a woven or knitted fabric, etc. In a preferred embodiment, the fibers are in the form of a felt that is particularly adapted for use in the storage of gases as, for example, in the storage of hydrogen for fuel cells. Another end use for the felt is in the separation of a mixture of gases.

Additionally, it is also within the scope of the invention to treat the activated fibers with any of the many activity enhancement agents know to those skilled in the art such as metal salts such as silver salts and other transition metal ion salts, halogens, organic compounds including quaternary salts, organosilicone compounds to enhance the activity of the activated biregional fibers of the invention.

Further objects of the invention, not specifically recited herein above, will become apparent from a reading of the detailed description of the invention.

DETAILED DESCRIPTION OF THE INVENTION

It has now known that the extent of oxidation stabilization of an acrylic fiber can be substantially reduced by oxidizing only an outer portion or region (when viewed in cross section) while the inner portion or core of the fiber remains in a thermoplastic and non-stabilized condition. Achieving stabilization of only an outer region of a fiber can therefor be conducted over a much shorter period of time, depending on the extent of oxygen penetration into the fiber and the desired thickness of the stabilized outer fiber sheath. Typically, the ratio of the radius of the core with respect to the total radius of the fiber is from about 1:4 to about 1:1.05, preferably from about 1:3 to about 1:1.12, and depends entirely upon the desired physical characteristics and intended use for the fiber. At a ratio of 1:4, it can be calculated that the percentage volume that is represented by the core is about 6% by volume, leaving about 94% for the outer sheath. At a ratio of 1:1.05 the percentage volume that is represented by the core is about 91%, leaving about 9% for the outer sheath. It is generally preferred to keep the ratio at a value where the volume of the outer sheath is preferably less than 25%, which represents a ratio of about 1:1.12 to less than 1:1.15 in order to keep the time of oxidation or carbonization treatment at a minimum.

As is disclosed in the above acknowledges patents issued to F. P. McCullough, the oxidatively stabilized fibers are heat treated in an inert atmosphere and for a period of time sufficient to form an outer region of a carbonaceous sheath thus forming a biregional carbonaceous fiber.

From the previously mentioned U.S. Patents to McCullough, polymeric materials that can be suitably used to make oxidation stabilized or carbonized biregional fibers include any of the well known polymers that are capable of being stabilized and carbonized to form the flexible biregional fibers. Exemplifications of such polymeric materials are copolymers and terpolymers of polyacetylene, polyphenylene, polyvinylidene chloride, and polyacrylonitrile. Other well known polymeric materials include polyamides (KEVLAR® brand p-aramid), polybenzimide resin, SARAN®, and the like. Mesophase pitch (petroleum or coal tar) containing particulate impurities or additives can also suitably be employed, so long as the thermal treatment does not leave any extractable polynuclear aromatics. Preferably, the polymeric precursor material is an acrylic or a sub-acrylic polymer (as hereinafter defined).

It is known in the art and an accepted standard, imposed by the Federal Trade Commission, that the term "acrylic" applies to any long chain synthetic polymers composed of at least 85 mole percent by weight of acrylonitrile units and less than 15 mole percent of another polymer. Fibers made from these acrylic materials are generally wet spun and are limited to fibers having a circular cross-section. Acrylic polymers that are the materials of choice in preparing the biregional fibers are selected from one or more of the following: acrylonitrile based homopolymers, acrylonitrile based copolymers and acrylonitrile based terpolymers. The copolymers typically contain at least about 85 mole percent of acrylonitrile units and up to 15 mole percent of one or more monovinyl units that are copolymerizable with acrylonitrile including, for example, methacrylic acid esters and acrylic acid esters such as methyl methacrylate, ethyl methacrylate, propyl methacrylate, butyl methacrylate, methyl acrylate and ethyl acrylate; vinyl esters such as vinyl acetate and vinyl propionate; acrylic acid, methacrylic acid, maleic acid, itaconic acid and the salts thereof; vinylsulfonic acid and the salts thereof.

Flexible biregional fiber(s) can also be made from a sub-acrylic precursor polymer which consists of a long chain polymer selected from the group consisting of copolymers and terpolymers containing less than 85 mole percent acrylic units but more than 15 mole percent of the above mentioned monovinyl units, copolymerized therewith. The amount of a plasticizer that can be present in a sub-acrylic polymer is preferably from greater than 15% to about 25% by weight. However, as much as 35 mole percent of the monovinyl units can be blended with the acrylic units to render the blend more easily melt extrudable through an extrusion nozzle or nozzles while the polymer blend is in a heat softened condition. The so extruded, heat softened filament can be stretched and attenuated, while under tension, to form a finer denier filament (i.e. in which the unit length of the fiber is increased with respect to the weight) having a relatively smaller diameter as compared to extruded fibers made from a standard acrylic resin. The sub-acrylic polymer can preferably be employed in extruding a filament having a noncircular cross-section.

The plasticizer can be any organic compound that can be added to or blended with a high polymer to facilitate processing and to increase the flexibility and toughness of the final product by internal modification (solvation) of the polymer molecule. Suitable plasticizers include, for example, vinyl chloride, methyl acrylate, methyl methacrylate, polyvinyl chloride and cellulose esters, phthalates, adipates, and sebacate esters, polyols such as ethylene glycol and its derivatives, tricresyl phosphate, caster oil, etc.

In accordance with the procedure employed in the process of the invention, oxidation stabilized biregional fibers, as made by the process disclosed in McCullough U.S. Pat. Ser. No. 5,763,103, are passed through a high temperature furnace containing an activating gas. The furnace is maintained at a temperature of from about 600° to about 1000° C. The fibers remain in the furnace for a time sufficient to activate at least a portion of the outer oxidation stabilized region of the fibers thereby forming a porous, e.g. honey comb like structure, having an extremely large internal surface area of from about 50 $m^2$/gm (square meters per gram) to greater than about 2000 $m^2$/gm, depending on the diameter of the fiber. The temperature and time of treatment are somewhat dependent on the diameter of the fibers and the gas(s) selected for activation. Any activating gas known in the art to be useful in making activated carbon materials can be used to produce the activated biregional fibers of the invention. The activating gas preferably is selected from steam, carbon dioxide, or mixtures thereof. Selection of the activating gas is dependant on the type of porous internal surface that is desired. Thus, if the activating gas is carbon dioxide ($CO_2$), the majority of the pores are relatively small and on the order of 6 Angstrom or less in diameter. If the activating gas is steam, there are more larger pores on the order of 6 to 20 Angstroms and even a significant number of pores in the 20 to 1000 Angstrom range. If a mixture of the two gases is used, a complex distribution of the pores occurs consisting of a multiplicity of small diameter pores distributed within the larger pores, thus forming a combination of pore diameters. Other activation gases such as are well known in the art can also be used in the process of the invention. Examples of other well-known gases include CO and oxygen.

The activated biregional fiber(s) of the invention can be formed in a batch or, preferably, in a continuous process in which the dynamic flow of the activating gas and the time and temperature affect the total surface area and relative distribution, size and nature of the pores that are produced in the activation process. The activation may be carried out on individual fibers or fiber assemblies, exemplary of which are cloths, felts, battings, webs and the like. If a continuous process is employed, activation of the outer region of the fiber(s) is more readily controlled while keeping the inner core region unaffected, i.e. in a thermoplastic condition. Presently, activated particles or fibers are carbon activated throughout so that they are extremely brittle and will readily break or crumble if roughly handled, especially if it is desired to process fibers, for example, in a textile machine. They will also readily deteriorate in general use. Accordingly, the activated biregional fibers of the invention allow for the production of a fabric in a textile machine without breakage of the fibers due to the presence of a flexible inner core of the thermoplastic material (composition) in the fiber.

Activated biregional fibers can be produced not only from oxidation stabilized biregional fibers but also from carbonized or partially carbonized biregional fibers in which the inner core is of a thermoplastic composition while the outer sheath region is partially or fully carbonized. By fully carbonized it is meant that the carbon content of the outer region is greater than 96%, where it is graphitic but still remains flexible due to the presence of the inner thermoplastic core. The biregional activate carbon fibers of the invention have a density of from about 0.5 to about 1.8 $g/cm^3$ The activated biregional fibers of the invention can be used in a multitude of manufactured articles such as, engineering textiles including woven or non-woven fabrics, knits or felts, various types of filters as, for example, in air and water purification such as in the removal of noxious gases from stack gases, solvent recovery, catalyst for natural gas purification, electroplating, air conditioning, etc.

A principal advantage of the biregional activated fibers of the invention is that they have very rapid kinetics compared to granules due to the small fiber diameters of, for example, 4 to 50 microns. An additional advantage of the activated biregional fibers is that they are non-flammable and non-toxic if inhaled.

It is also contemplated and within the scope of the invention to coextrude two or more polymers of different compositions such that the core of the fiber is formed of one polymer, while the outer sheath of the fiber is formed of another polymer. The outer sheath of such a bipolymeric fiber can then be oxidatively stabilized or carbonized and then activated in accordance with the procedure of the present invention. By way of example, the inner polymeric core material can be selected from any of a variety of polymers known in the art such as, for example, Kevlar™, polybenzimidazole (PBI), polycarbonate, polypropylene, ethyleneacrylic acid, polyester, polytetrafluoroethylene (PTFE), to provide the fiber with a desired physical characteristic, such as high strength, transparency, etc. A prerequisite for the manufacture of a bipolymer fiber is that the different polymers are compatible, have a similar melt index value and that they will adhere to each other at their contact surfaces. If the melt index values are dissimilar, an intermediate layer of a compatibilizing polymer can be coextruded between the inner core and the outer sheath polymers. The thus coextruded fiber can then be oxidatively stabilized and heat treated to carbonize the outer sheath.

The flexible biregional fiber(s) can also be made more easily and at a substantially lower manufacturing cost from an unfiltered polymeric material such as, for example, an acrylic or sub-acrylic polymer that can contain from about 0.0001 to about 5% by weight particulate matter having a diameter of less than about 0.1 microns, preferably less than 0.001 microns. Sub-micron particles are naturally present in any polymeric material and thus will also be present in polymeric materials that are extruded to form fibers for use in the manufacture of textile articles, for example. These particles are generally organic or inorganic materials, which are insoluble in the polymeric melt or dope. The term "unfiltered" used herein applies to polymeric materials which, when in a melt phase and during manufacture, are not subjected to the usual micro-filtration procedure to remove impurities, such as non-polymeric inclusions, from the polymeric material.

The activated biregional fiber of the invention is essentially continuous, i.e. it can be made to any desired length, it can be essentially linear or nonlinear (i.e. crimped in a conventional manner), and possess a high degree of flexibility which manifests itself in a fiber which has a much greater ability to withstand shear, which is not brittle, and which has a bending strain value of from greater than 0.01 to less than 50%, preferably from about 0.1 to about 30%. These properties allow the activated biregional fiber to be formed into a variety of assemblies or configurations for use in many different types of applications, such as battings, webs, etc. In contrast, the bending strain value of a conventional carbon or graphitic fiber with a high modulus is substantially less than 0.01% and often less than 0.001%. Although the activated biregional fiber of the invention can have a diameter of as large as 50 microns, it is preferred to form the fiber(s) of a relatively small diameter of from about 6 to about 30 microns, preferably from about 15 to about 25 microns, since the diameter of the fiber is generally proportional to its surface area. The activated biregional fibers of the invention preferably have a breaking twist angle of 4 to 20 degrees which is greater than that found for glass and traditional carbon fibers and much greater than that found for activated carbon fibers of the prior art which or typically less than 2 degrees.

The activated biregional fiber(s) of the invention should preferably have the following physical property criteria:

(1) A ratio (r: R) of the radius of the core region (r) with respect to the total radius of the fiber (R) of from about 1:4 to about 1:1.05, preferably from about 1:3 to about 1:1.12

(2) A typical density of from about 0.5 to about 1.8 g/cm3. It should be understood, however, that the density of the fiber is dependent upon the ratio (r: R) of the radius of the core (r) with respect to the diameter of the fiber (R).

(3) An aspect ratio of greater than 100:1 (the aspect ratio is defined herein as the length to diameter 1/d ratio of the biregional carbon activate fiber), and a fiber diameter of from about 1 to about 50 microns, preferably from about 6 to about 30 microns, more preferably from about 15 to about 25 microns.

(4) An internal surface area with respect to the activated surface of the biregional fiber of from 50 $m^2/g$ to greater than 2000 $m^2/g$, depending somewhat on the diameter of the activated fiber (5) The majority of the pore structures of the activated biregional fiber have diameters from greater than 0 to 20 Angstroms.

(6) The process conditions for spinning polymeric fibers of the compositions disclosed in the present application are generally known in the art. Generally, the polymeric fiber(s) is oxidatively stabilized in a stabilization chamber at a temperature of from about 150° to 300° C. in an oxidizing atmosphere. The time of oxidation for the fibers is less than 1 hour, preferably less than 30 min. The so produced biregional oxidation stabilized fiber will exhibit distinct visually discernible regions of an inner core of a thermoplastic polymer and an outer region of an oxidized sheath.

(7) The fiber is ignition resistance having a LOI of greater than 40 and is non-flammable.

(8) A breaking twist angle of from about 4 to about 20 degrees.

(9) A bending strain value of from about 0.01 to about 50%, preferably from about 0.1 to about 30%.

In accordance with known procedures, the oxidation stabilized biregional fiber(s) is optionally subjected to a carbonization treatment at a higher temperature and in a non-oxidizing atmosphere. The time of carbonization for the biregional oxidation stabilized fibers is less than about 5 min., preferably from about 45 sec. to 3 min., depending on various factors such as diameter of the fibers, etc. and on the degree of carbonization desired.

Activated biregional fibers of the invention can be formed into various assemblies consisting of a multiplicity of randomly entangled fibers in the form of a wool-like fluff, a generally planar non-woven sheet, web or batting, a compression formed panel, a woven or knitted fabric, or the like.

With the pore size distribution, surface area, high temperature stability and fast kinetics with gases, the activated fibers of the invention can be used in processes for the separation of mixtures of gases, such as is presently done by zeolite and carbon molecular sieves, and for storage of gases such as hydrogen for fuel cell applications to give improved safety, economics and performance.

Example 1

A 400 k (1 k=1000 fibers) tow of acrylic fibers containing approximately 94% acrylonitrile, 4% methacrylate and approximately 2% itaconic acid is made by the traditional wet spinning method. The acrylic fibers have an average denier of 4.5 and a diameter of 21.5 microns. The fiber tow is then oxidation stabilized in a dynamic flow of air while under tension at a temperature and time sufficient to oxidize the outer portion of the fiber and form a biregional fiber. The density of the resulting oxidation stabilized biregional fiber is 1.34 g/cm$^3$. The fiber is cut and analyzed under a polarized light microscope and shows a clear differentiation between a black oxidation stabilized thermoplastic outer sheath and a translucent to lightly colored inner, non-oxidized thermoplastic core. The oxidized outer sheath of the fiber is not physically separated by a boundary or discontinuity from the non-oxidized core, when viewed in cross section. The ratio of the radius of the core to the radius of the fiber is measured and determined to be 1:1.22. The breaking twist angle was determined to be 15.5. The fiber tow is crimped in a steam crimper and chopped into 75 mm staple length. The chopped biregional oxidation stabilized fiber is carded and needled into a 4 oz/yd$^2$ needle punched felt ("NPF").

Two activation procedures are carried out on the above felt:

(a) The felt in placed outside the heated zone of a tube furnace at room temperature under an $O_2$ free $N_2$ atmosphere for 10 minutes, then is activated by introducing the felt into the heated chamber in a dynamic stream of $CO_2$ at a temperature of 820° C. while in a relaxed and unstressed condition for a period of approximately 30 minutes. The resulting activated felt of activated biregional fibers contains fibers with a Nitrogen measured surface area of 500 m$^2$/g, with a total mercury pore volume (20–1000 Angstrom width) of 0.220 cc/g, a micropore volume (greater than 0 to 20 Angstroms width) of 0.208 cc/g, consisting of narrow micropores (greater than 0 to 6 Angstroms width) of 0.193 cc/g, and broad micropores (6–20 Angstroms) of 0.015 cc/g.

The activated biregional fibers have an aspect ratio of greater than 10,000:1 and a nominal fiber diameter of 20 microns. The fibers are ignition resistant, non-flammable and flexible, have a bending strain value of 0.1%, a density of 0.8 g/cm$^3$, a breaking twist angle of 5.5, and a LOI of greater than 40. Analysis of the cross sectional area of a single fiber under a polarized light microscope shows a clear visual distinction between a black thermoset carbonaceous outer sheath and a translucent to lightly colored inner, non-oxidized thermoplastic core. The carbonized outer sheath of the fiber is continuous and is not physically separated from the thermoplastic core, when viewed in cross section, by a boundary or discontinuity.

(b) In another experiment, the needle punched felt (NPF) is activated in a dynamic stream of $CO_2$ at a temperature of 875° C. in a tube furnace for a period of approximately 25 minutes. The resulting felt of biregional fibers contains fibers with a Nitrogen measured surface area of 800 m$^2$/g with a total mercury pore volume (20–1000 Angstrom width) of 0.348 cc/g, a micropore volume (greater than 0 to 20 Angstroms width) of 0.331 cc/g, consisting of narrow micropores (greater than 0 to 6 Angstroms width) of 0.290 cc/g, and broad micropores (6–20 Angstroms) of 0.041 cc/g.

Example 2

The needle punched felt (NPF) of example 1is subjected to activation with a dynamic flow of steam at 860° C. for 5 minutes. The resulting felt of biregional fibers contains fibers with a Nitrogen measured surface area of 525 m$^2$/g. The total pore volume was 0.254 cc/g, the micropore volume (greater than 0 to 20 Angstroms) was 0.225 cc/g, with 0.188 cc/g of narrow pore volume (greater than 0 to 6 Angstroms), 0.037 cc/g of the broad pore volume (6–20 Angstroms) and mesopores (20–500 Angstroms width) of 0.029 cc/g.

What is claimed is:

1. An ignition resistant biregional fiber having an LOI of greater than 40 comprising an inner core of a thermoplastic polymeric composition and a surrounding outer sheath comprising a porous activated carbonaceous material, the pores in said outer sheath having an internal surface area of from about 151 m$^2$/g to greater than 2000 m$^2$/g.

2. The fiber of claim 1, wherein the density of the fiber ranges from about 0.5 to about 1.8 g/cm$^3$.

3. The fiber of claim 1, wherein the pores in the activated outer region of the fiber have a size of from less than 2 to about 18 Angstroms.

4. The fiber of claim 1, wherein said fiber is flexible and has a bending strain value of greater than 0.01 to less than 50%.

5. The fiber of claim 1, having a generally circular or non-circular cross sectional shape.

6. The fiber of claim 1, having a diameter of from greater than 4 to about 45 micrometers.

7. The fiber of claim 1, having a breaking twist angle of from 4 to about 20 degrees.

8. An article of manufacture according to claim 1, comprising a multiplicity of said activated biregional fibers, wherein said fibers are randomly entangled and in the form of a wool-like fluff, a generally planar non-woven sheet, web, felt or batting, a compression formed panel, a woven or knitted fabric.

9. The article of claim 8, wherein the multiplicity of activated biregional fibers is a felt for use in the separation of mixtures of gases and for the storage of gases such as hydrogen for fuel cells.

* * * * *